US007231695B2

(12) United States Patent
Park

(10) Patent No.: US 7,231,695 B2
(45) Date of Patent: Jun. 19, 2007

(54) APPARATUS FOR AUTOMATICALLY LOCKING THE SHIP CONTAINER

(76) Inventor: Se-Jong Park, 103-1114, Byeongyoungsamil Apt. 529-2, Namoe-dong, Jung-gu 681-270, Ulsan (KR)

( * ) Notice: Subject to any disclaimer, the term of this patent is extended or adjusted under 35 U.S.C. 154(b) by 98 days.

(21) Appl. No.: 10/516,371

(22) PCT Filed: Jan. 13, 2003

(86) PCT No.: PCT/KR03/00063

§ 371 (c)(1),
(2), (4) Date: Apr. 29, 2005

(87) PCT Pub. No.: WO03/101823

PCT Pub. Date: Dec. 11, 2003

(65) Prior Publication Data

US 2005/0210636 A1 Sep. 29, 2005

(30) Foreign Application Priority Data

May 30, 2002 (KR) ..... 10-2002-0030383

(51) Int. Cl.
*F16D 1/10* (2006.01)
*F16D 1/108* (2006.01)

(52) U.S. Cl. ..... 24/287; 403/325; 220/23.4; 410/82

(58) Field of Classification Search ..... 24/287, 24/288, 595.1, 602, 605, 611, 606–608, 697.1, 24/698.1, 580.1, DIG. 53–DIG. 59; 403/325, 403/321, 335, 374.5, 385; 220/23.4; 410/82, 410/83, 73, 76
See application file for complete search history.

(56) References Cited

U.S. PATENT DOCUMENTS

| | | | | |
|---|---|---|---|---|
| 3,456,967 | A * | 7/1969 | Hulverson et al. | 24/287 |
| 3,691,595 | A * | 9/1972 | Backteman et al. | 24/287 |
| 3,697,104 | A * | 10/1972 | Soulie et al. | 403/168 |
| 4,082,052 | A * | 4/1978 | Looks | 410/82 |
| 5,002,418 | A * | 3/1991 | McCown et al. | 403/24 |
| 5,548,877 | A * | 8/1996 | Nitsche | 24/287 |
| 5,893,692 | A * | 4/1999 | Asanuma | 410/83 |
| 6,113,305 | A * | 9/2000 | Takaguchi | 403/321 |
| 6,334,241 | B1 * | 1/2002 | Flodin | 24/287 |
| 6,336,765 | B1 * | 1/2002 | Watanabe | 403/325 |
| 6,692,203 | B2 * | 2/2004 | Kim et al. | 410/69 |
| 2003/0164375 | A1 * | 9/2003 | Neufingerl | 220/23.4 |

* cited by examiner

*Primary Examiner*—Jack W. Lavinder
(74) *Attorney, Agent, or Firm*—Schmeiser, Olsen & Watts

(57) ABSTRACT

An apparatus for automatically locking ship containers. The apparatus has a housing having a pair of housing halves which are symmetrical to each other, an operating element having a pair of operating element halves which are symmetrical to each other and assembled with each other in the housing, and upper and lower lockers which are assembled with each other in the operating element. By operating the upper and lower lockers using a weight of a container, it is possible to lock and unlock containers loaded on a ship to and from each other.

1 Claim, 9 Drawing Sheets

PRIOR ART

APPARATUS FOR AUTOMATICALLY LOCKING THE SHIP CONTAINER

TECHNICAL FIELD

The present invention relates, in general, to an apparatus for locking containers loaded on a ship to be transported and, more particularly, to an apparatus for automatically locking ship containers, in which a locker is operated by the weight of a container to automatically connect and disconnect containers loaded on a ship to and from each other, so that the workability is improved when stacking containers one upon another and unloading the stacked containers one by one, and displacement and release of the containers are prevented due to an increase in the container maintaining force, thereby increasing safety.

BACKGROUND ART

As well known to those skilled in the art, containers designed for easy loading and unloading of freight are transported by a trailer or a ship. A trailer used for transporting containers is provided with a locking apparatus for fixedly maintaining the containers. Also, containers to be transported by a ship are provided with locking apparatuses so that the containers are locked to and unlocked from each other at their corner portions.

An apparatus for automatically locking containers to be transported by a trailer is disclosed in Korean Patent Application No. 2000-4080 filed on Jan. 27, 2000 and entitled "Apparatus for Automatically Locking Trailer Containers". The patent application was granted a patent on Mar. 21, 2002, and the present applicant is registered on a register of that patent as one of the joint inventors.

Hereafter, the conventional apparatus for locking ship containers will be described with reference to FIGS. 1*a* and 1*b*. The apparatus includes a housing 1 which has a center opening, a rotating body 2 which is rotatably inserted through the center opening of the housing 1, upper and lower locking heads 3 and 4 which are respectively formed integrally with upper and lower ends of the rotating body 2, and a handle 5 which is coupled to a middle portion of the rotating body 2 to rotate the rotating body 2. Adjacent to a lower end of the upper locking head 3, a groove 6 is defined on an outer surface of the rotating body 2. Adjacent to an upper end of the housing 1, an insertion groove is defined on an inner surface of the housing 1. A spring 13 and a ball 14 are inserted into the insertion groove in a manner such that the ball 14 is biased by the spring 13 in a direction where the ball 14 is engaged into the groove 6 of the rotating body 2.

In the conventional locking apparatus constructed as mentioned above, in a state wherein a first container C1 is loaded on the bottom of a ship, a second container C2 is loaded on the first container C1. At this time, as shown in FIG. 1*a*, the locking apparatus is fitted into a first corner casting 61*a* which is provided on a lower surface of the second container C2. Then, the handle 5 which is directed forward is rotated rightward by a predetermined angle. By this, the rotating body 2 is slightly rotated rightward, and at the same time, the upper and lower locking heads 3 and 4 are integrally rotated rightward.

By this operation, the upper locking head 3 is partially placed on a first shoulder which is formed in the first corner casting 61*a* provided on the lower surface of the second container C2.

In this state, the second container C2 is lifted using a crane and loaded on the first container C1 which is already loaded on the bottom of the ship. At this time, the lower locking head 4 which is held slightly rotated through rotation of the handle 5 is fitted into a second corner casting 61*b* which is provided to an upper surface of the first container C1.

Thereupon, the handle 5 which is held slightly rotated is further rotated rightward, whereby the upper and lower locking heads 3 and 4 are completely placed on their respective first and second shoulders of the first and second corner castings 61*a* and 61*b* which are provided to the second and first containers C2 and C1. At this time, the ball 14 which is biased outward of the insertion groove by the spring 13 is engaged into the groove 6 of the rotating body 2 to prevent unintentional rotation of the rotating body 2.

In this way, the first and second containers C1 and C2 loaded on the ship are securely fixed to each other.

However, the conventional container-locking apparatus suffers from defects in that, since the entire locking operations are manually conducted, a great deal of time and energy are required. That is, the manual locking operations lengthen the container loading time. Also, due to the laborious and time-consuming nature of the locking operations, costs increase. Further, since a worker conducts the locking operations while on the container, a safety issue is roused.

Moreover, if the containers are not completely locked to each other, accidents may occur.

DISCLOSURE OF THE INVENTION

Accordingly, the present invention has been made keeping in mind the above problems occurring in the prior art, and an object of the present invention is to provide an apparatus for automatically locking ship containers, which is constructed in such a way as to improve the workability when stacking containers one upon another and unloading the stacked containers one by one and ensure that accidental displacement and release of the containers are prevented due to an increase in container maintaining force, thereby increasing safety.

In order to achieve the above object, according to the present invention, there is provided an apparatus for automatically locking ship containers, comprising: a housing having a seating surface on which a projection of an operating element is seated, a locking pin which is partially introduced into a sloped groove of a lower locker, and an insertion groove in which a spring and a ball are inserted; the operating element being defined with a center opening and placed in the housing so that it can be moved upward and downward, the operating element having a tapered cut portion which is formed to allow the locking pin of the housing to extend into the center opening, an engagement groove in which a protrusion formed on an outer surface of the lower locker is engaged, and a shoulder which is to be brought into contact with a corner casting of a lower container; an upper locker having an upper locking head which performs a locking function in a corner casting of an upper container, a rotating body which is defined with a receiving groove in which the ball inserted in the insertion groove of the housing can be received, and a stem portion which is integrally connected to the rotating body and around which a spring is placed, the upper locker passing through a center hole of the lower locker which is accommodated in the center opening of the operating element, to project beyond a lower end of the center hole; and the lower locker having the center hole through which the upper locker passes, the protrusion which is engaged in the engagement groove of the operating element, a lower locking head which performs a locking function in the corner casting of the lower container, and the sloped groove in which the locking pin formed adjacent to a lower end of the housing is partially introduced to be guided therealong.

BRIEF DESCRIPTION OF THE DRAWINGS

The above and other objects, features and other advantages of the present invention will be more clearly understood from the following detailed description when taken in conjunction with the accompanying drawings, in which.

BEST MODE FOR CARRYING OUT THE INVENTION

Figure 1A:
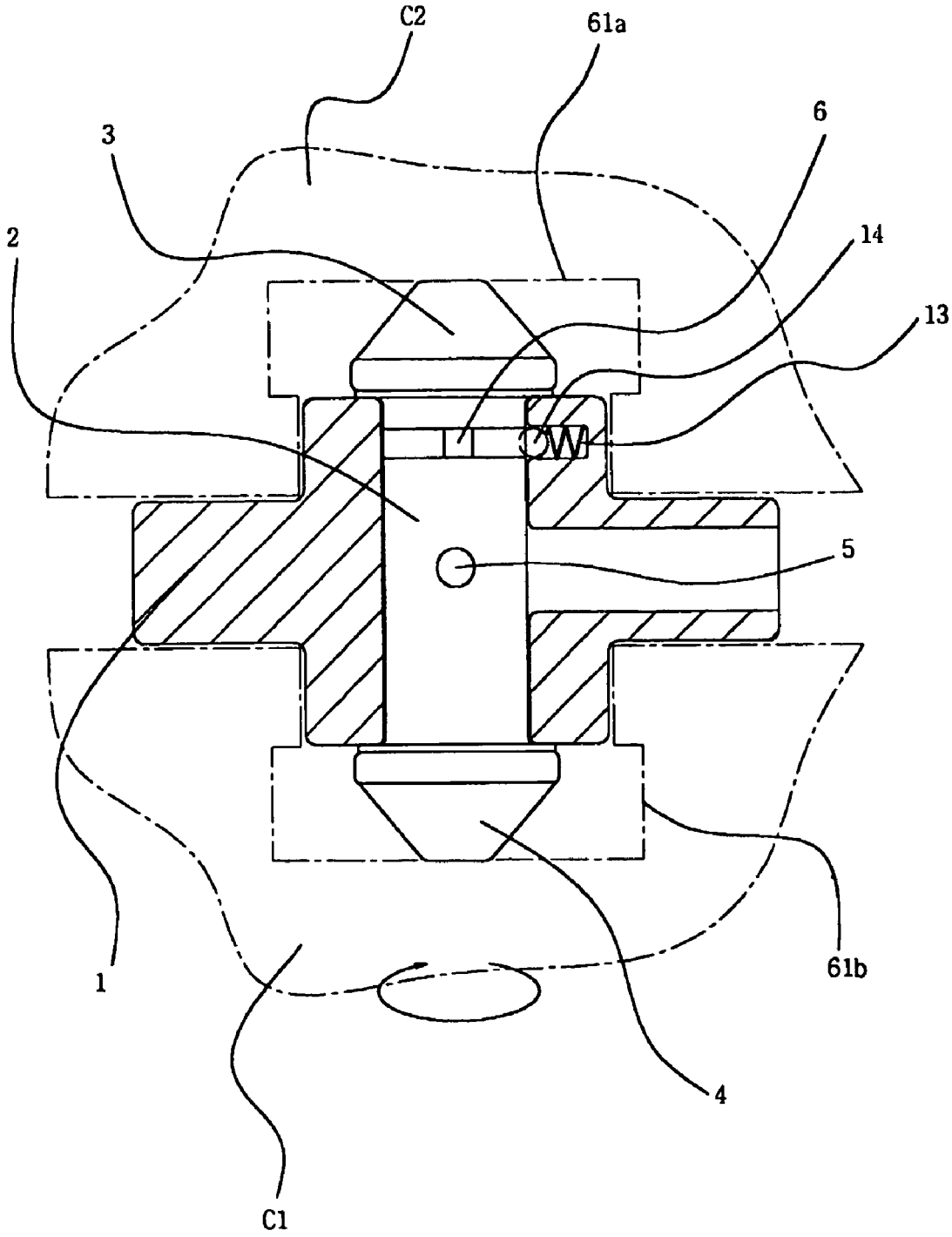
FIGS. 1*a* and 1*b* are sectional views illustrating the conventional apparatus for locking ship containers.
Figure 1B:
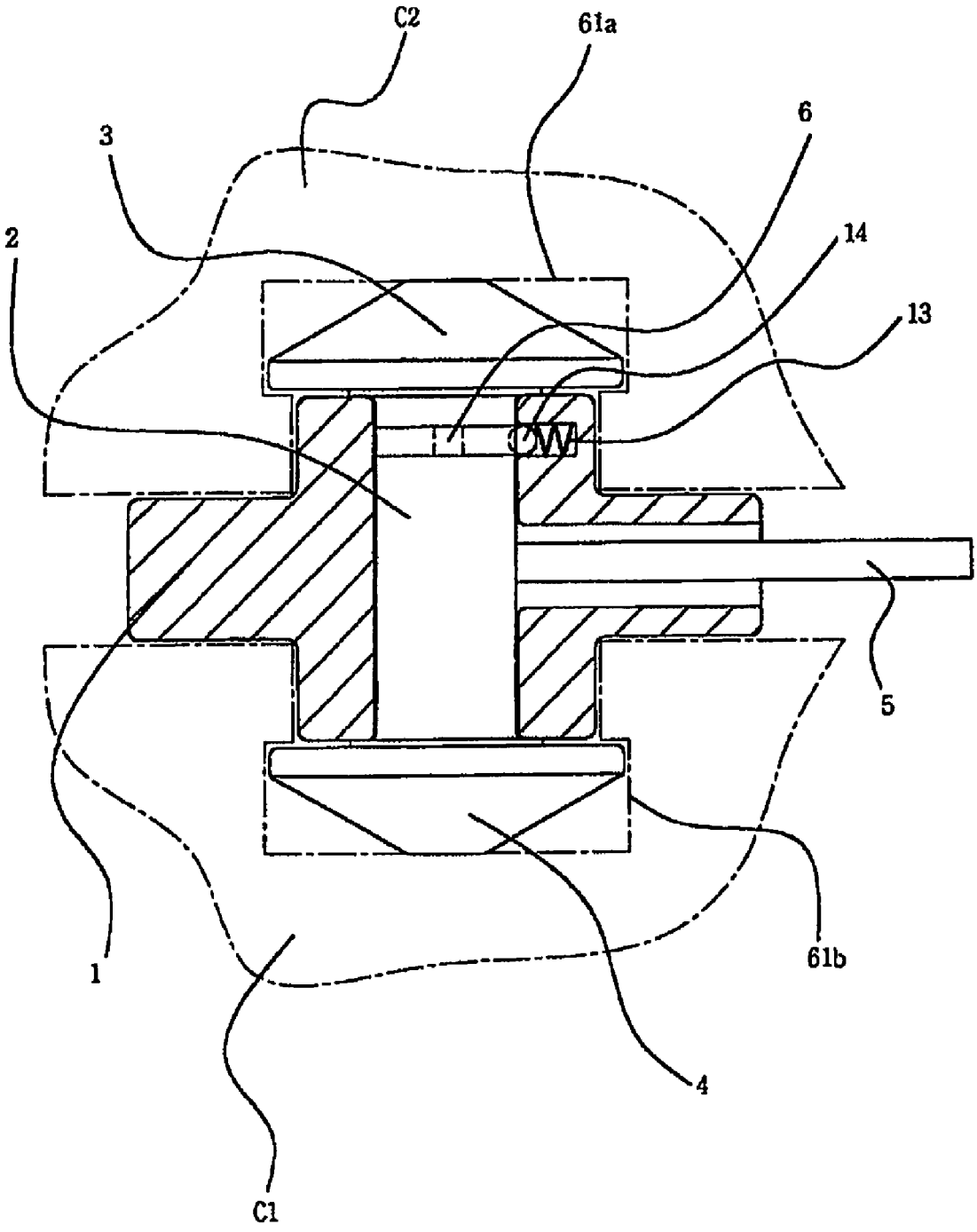

Reference should now be made to the drawings, in which the same reference numerals are used throughout the different drawings to designate the same or similar components.

Figure 2:
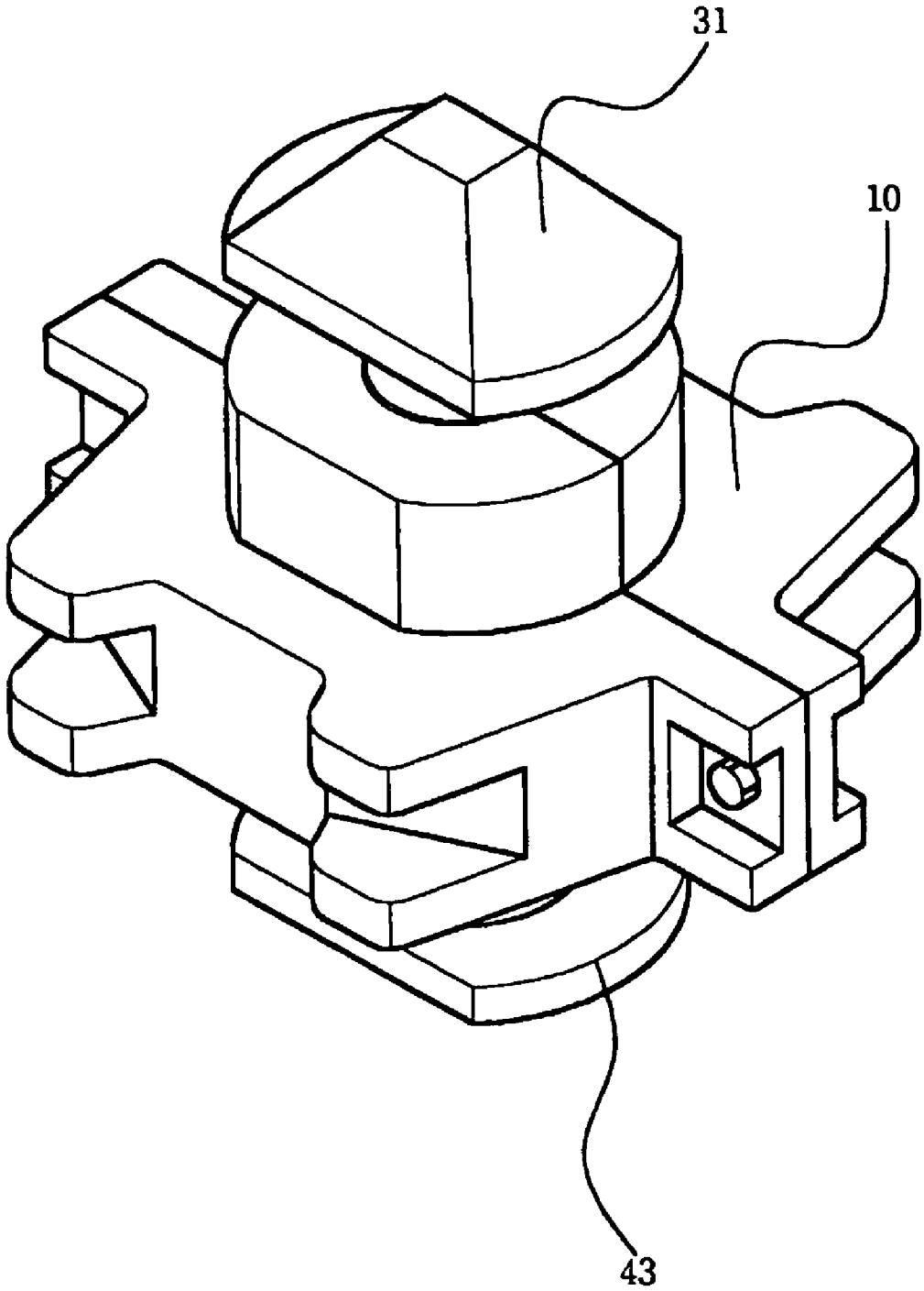
FIG. 2 is a perspective view illustrating an assembled state of an apparatus for automatically locking ship containers, in accordance with an embodiment of the present invention.
Figure 3:
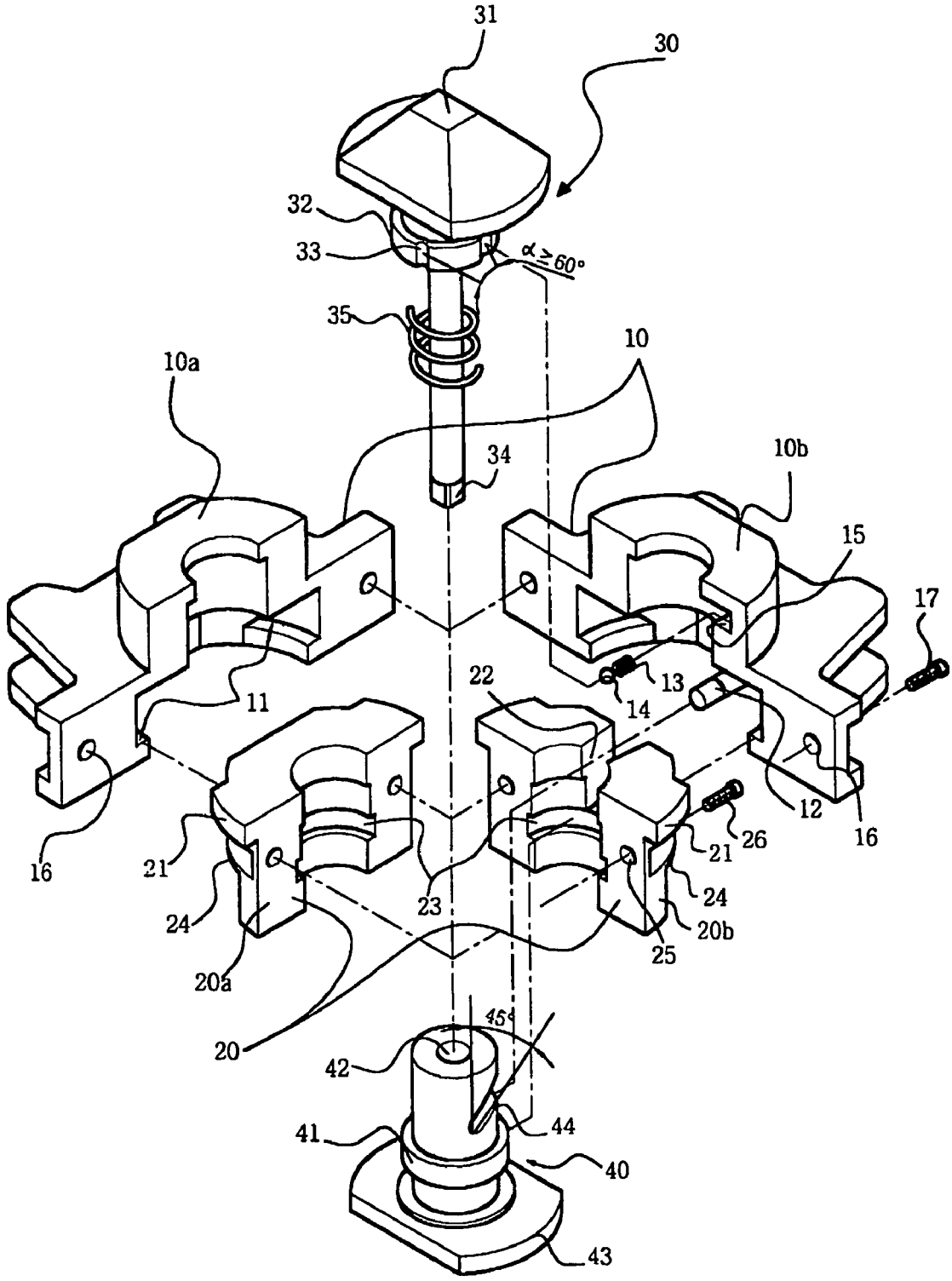
FIG. 3 is an exploded perspective view illustrating the apparatus for automatically locking ship containers according to the present invention.
Figure 4:
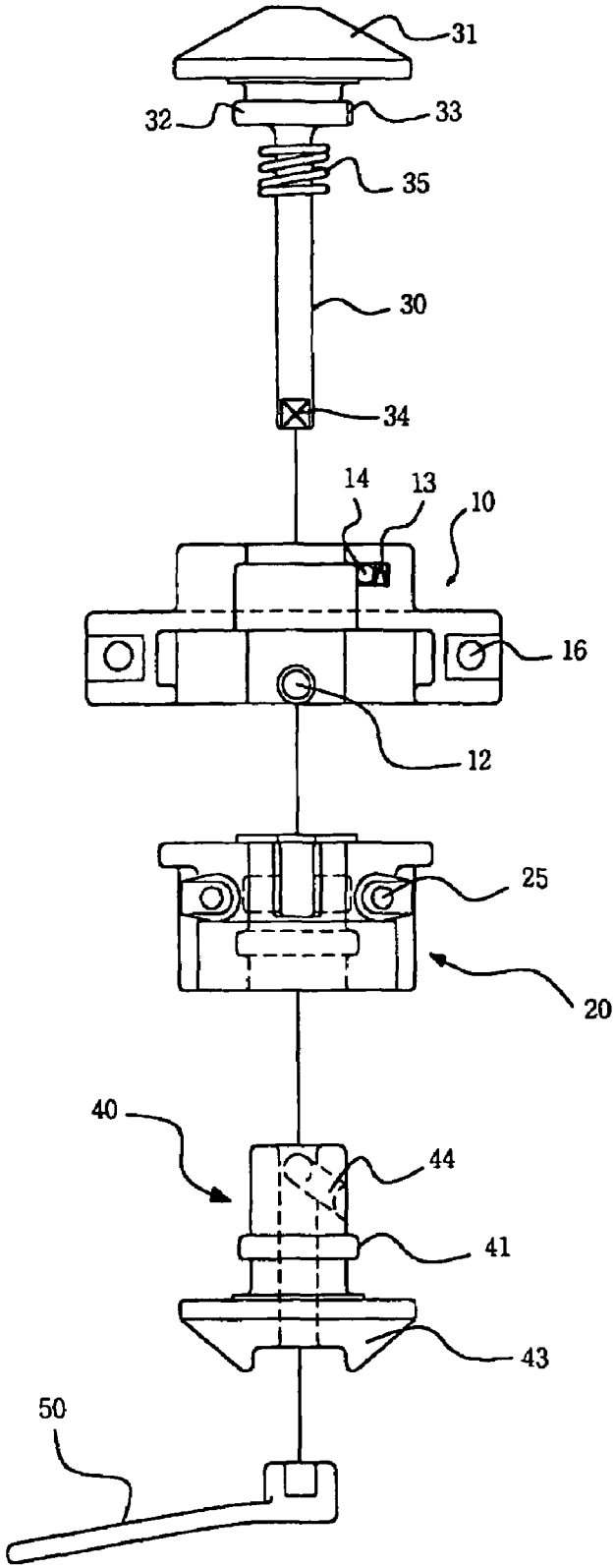
FIG. 4 is an exploded front view illustrating the apparatus for automatically locking ship containers according to the present invention.

FIG. 2 is a perspective view illustrating an assembled state of an apparatus for automatically locking ship containers, in accordance with an embodiment of the present invention; FIG. 3 is an exploded perspective view illustrating the apparatus for automatically locking ship containers according to the present invention; and FIG. 4 is an exploded front view illustrating the apparatus for automatically locking ship containers according to the present invention. As shown in FIGS. 2 through 4, an apparatus for automatically locking ship containers according to the present invention comprises a housing 10 which has left and right pieces virtually symmetrical to each other, an operating element 20 which, in the same manner as the housing 10, has left and right pieces symmetrical to each other and assembled in the housing 10, and upper and lower lockers 30 and 40 which are assembled in the operating element 20.

Hereafter, the apparatus for automatically locking ship containers according to the present invention, largely constructed as mentioned above, will be described in further detail.

The housing 10 is composed of left and right housing halves 10*a* and 10*b* which are assembled with each other and virtually symmetrical to each other. A seating surface 11 is formed adjacent to a lower end of each of the housings 10*a* and 10*b*, so that a projection 21 of the operating element 20 is seated on the seating surface 11. A locking pin 12 is formed on a widthwise middle portion of the lower end of the right housing half 10*b*. An insertion groove 15 is defined at a side adjacent to an upper end of the right housing half 10*b*, so that a spring 13 and a ball 14 can be inserted into the insertion groove 15.

In the above construction, in order to ensure that the operating element 20 can be moved upward and downward after the projection 21 of the operating element 20 is seated on the seating surface 11, a space is defined above the seating surface 11.

In the same manner as the housing 10, the operating element 20 is composed of left and right operating element halves 20*a* and 20*b* which are assembled with each other in the housing 10 and virtually symmetrical to each other. The right operating element half 20*b* has a tapered cut portion 22 which is formed to allow the locking pin 12 of the housing 10 to extend into a center opening which is defined at a center portion of the operating element 20. The left operating element half 20*a* does not have a tapered cut portion. An engagement groove 23 is defined on each inner surface of the left and right operating element halves 20*a* and 20*b*, so that a protrusion 41 which is formed on an outer surface of the lower locker 40 is engaged in the engagement groove 23. A shoulder 24 is formed on each outer surface of the left and right operating element halves 20*a* and 20*b*, so that the shoulder 24 is brought into contact with a corner casting of a container.

The upper locker 30 which is inserted into the center opening of the operating element 20 is integrally formed with an upper locking head 31 and a rotating body 32. A stem portion is integrally formed with a lower end of the rotating body 32. A pair of receiving grooves 33 are defined on an outer surface of the rotating body 32, in a manner such that the ball 14 inserted in the insertion groove 15 of the housing 10 and biased outward by the spring 13 can be received in one of the receiving grooves 33. A spring 35 is placed around the stem portion of the upper locker 30. The stem portion of the upper locker 30 has an elongate rod-shaped configuration. A lower end 34 of the stem portion has a quadrangular sectional shape in a manner such that the upper locker 30 can be rotated by a portable lever 50.

In the above construction, while it is most preferable that an angle '$\alpha$' defined by the pair of receiving grooves 33 is established at 90° so that the upper locking head 31 can be rotated by 90° from its initial position, it is sufficient that the angle '$\alpha$' is established as no less than 60°. The reason for this is that, when the angle '$\alpha$' has a magnitude of no less than 60°, the locking head 31 can be sufficiently rotated to be locked to the corner casting of the container.

The lower locker 40 which is accommodated in the center opening of the operating element 20 is defined with a center hole 42 through which the stem portion of the upper locker 30 passes. The lower locker 40 is integrally formed with a lower locking head 43 and the protrusion 41 which is engaged in the engagement groove 23 of the operating element 20. Above the protrusion 41, the lower locker 40 is defined with a sloped groove 44 into which one end of the locking pin 12 formed adjacent to the lower end of the housing 10 is inserted to be guided therealong.

The sloped groove 44 is defined to be sloped downward at an angle of 45° when measured from a vertical line. The reason for this is to allow the lower locking head 43 to be rotated and then locked to and unlocked from the corner casting of the container by cooperation between the locking pin 12 of the housing 10 and the sloped groove 44 of the lower locker 40.

Hereinbelow, assembling relationships of the apparatus for automatically locking ship containers according to the present invention, constructed as mentioned above, will be described with reference to FIGS. 3 and 4.

As can be readily seen from the drawings, the protrusion 41 formed on the outer surface of the lower locker 40 is engaged into the engagement groove 23 of the operating element 20, and then, by inserting bolts 26 through bolt holes 25 which are defined through the left and right operating element halves 20*a* and 20*b* and locking the bolts 26 using nuts, the left and right operating element halves 20*a* and 20*b* are firmly assembled with each other.

After the assembly of the left and right operating elements 20*a* and 20*b*, the stem portion of the upper locker 30 having place thereon the spring 35 is passed through the center hole 42 of the lower locker 40 which is accommodated in the center opening of the operating element 20. Then, the left and right housing halves 10*a* and 10*b* are assembled with each other. For this, first, the projection 21 of the operating element 20 is seated on the seating surface 11 of the housing 10. Further, the ball 14 which is inserted into the insertion groove 15 of the housing 10 and biased outward by the spring 13 is received in one of the receiving grooves 33 which are defined on the outer surface of the rotating body 32 of the upper locker 30.

Thereupon, by inserting bolts 17 through bolt holes 16 which are defined through the left and right housing halves 10*a* and 10*b* and locking the bolts 17 using nuts, the left and right housing halves 10*a* and 10*b* are firmly assembled with each other.

At this time, the locking pin 12 which is formed adjacent to the lower end of the right housing half 10*b* is extended through the tapered cut portion 22 of the right operating element half 20*b* and is inserted into the sloped groove 44 of the lower locker 40 which is, accommodated in the center opening of the operating element 20 to be guide therealong.

Hereafter, the operations of the apparatus for automatically locking ship containers according to the present invention, assembled as mentioned above, will be described with reference to FIGS. 5*a* through 6.

Figure 5A:
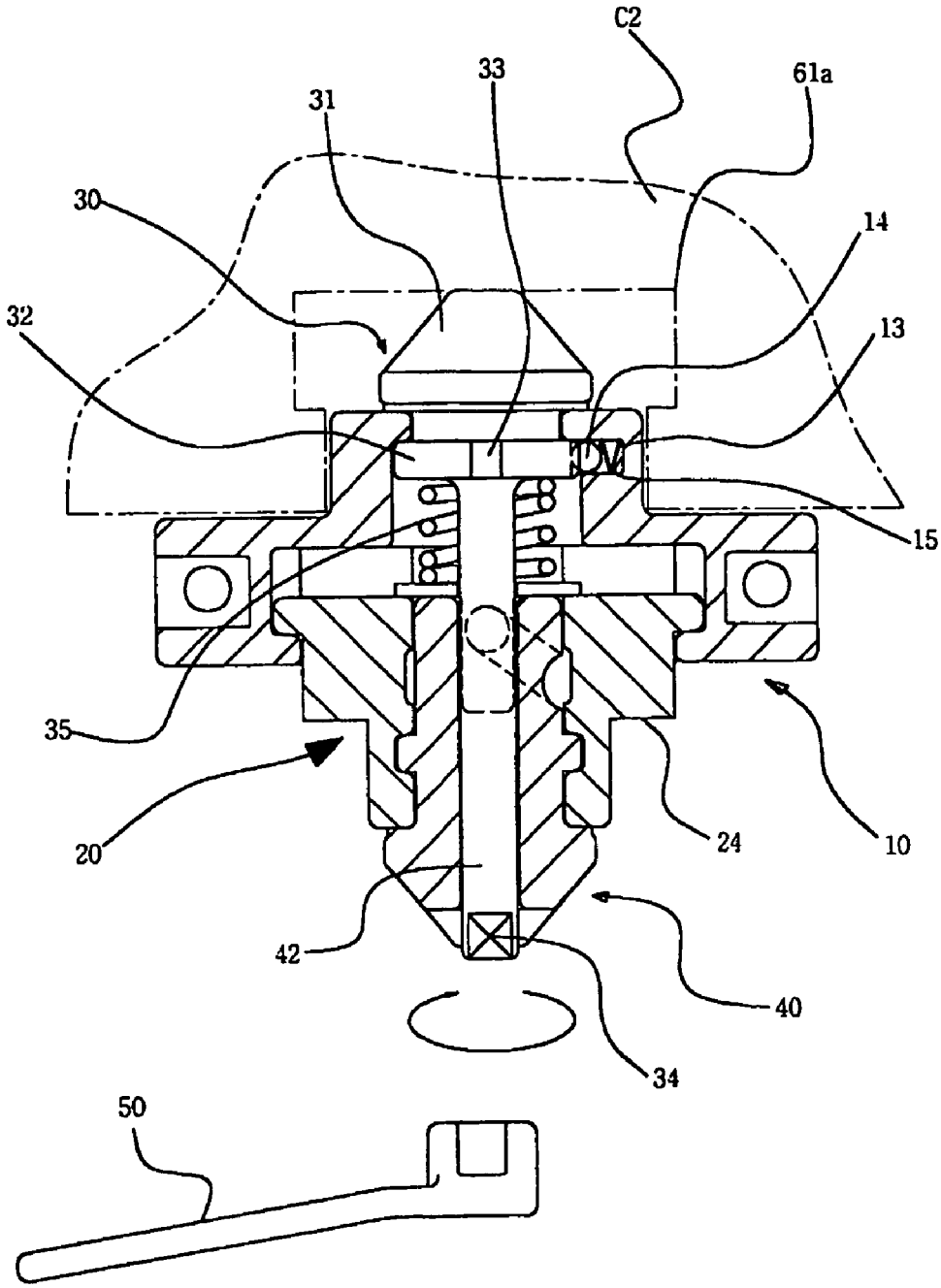
FIG. 5*a* is a sectional view illustrating an initial position of the apparatus for automatically locking ship containers according to the present invention.
Figure 5B:
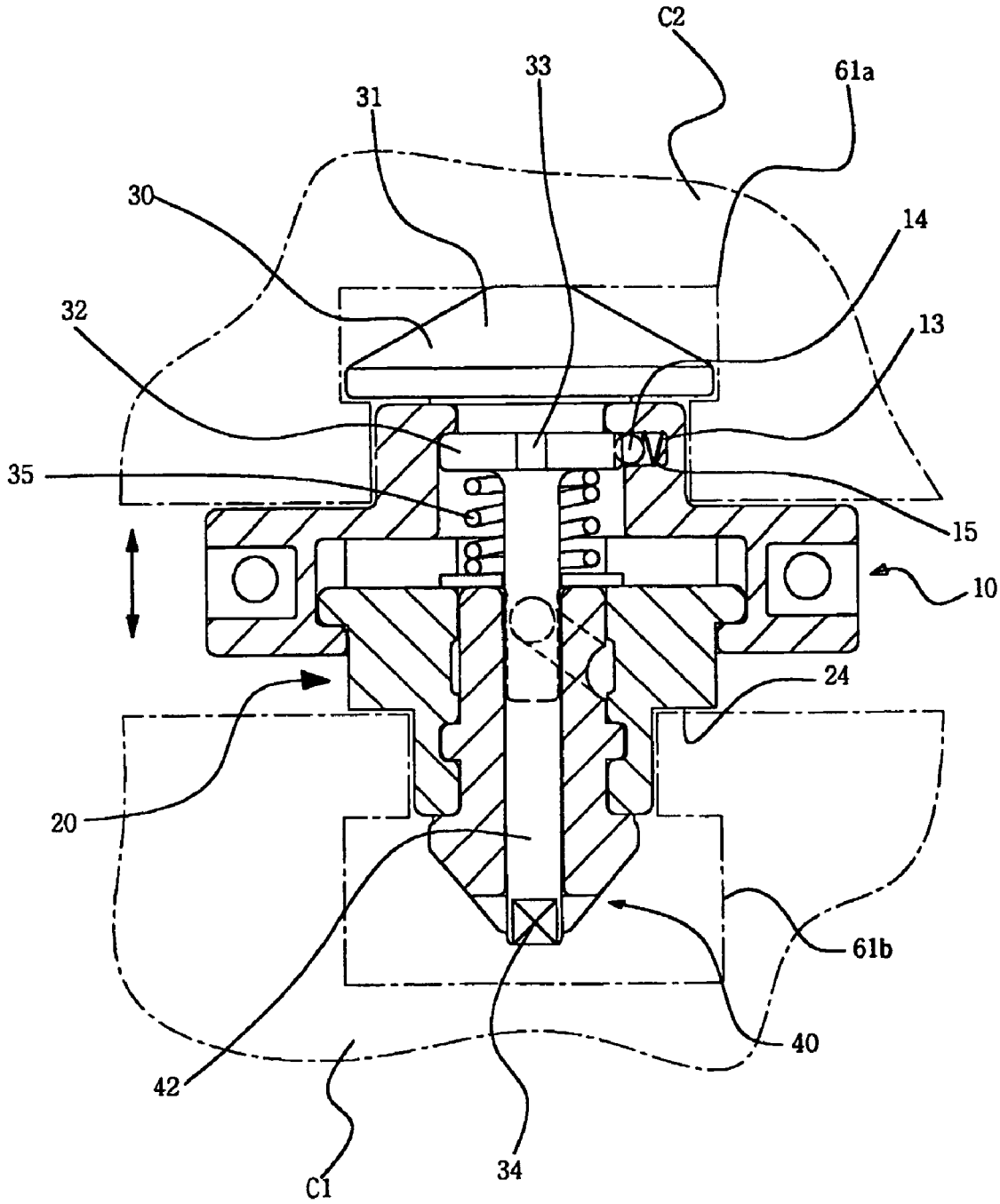
FIG. 5*b* is a sectional view illustrating a state wherein an upper locking head of the apparatus for automatically locking ship containers according to the present invention is locked to a corner casting of a container.
Figure 5C:
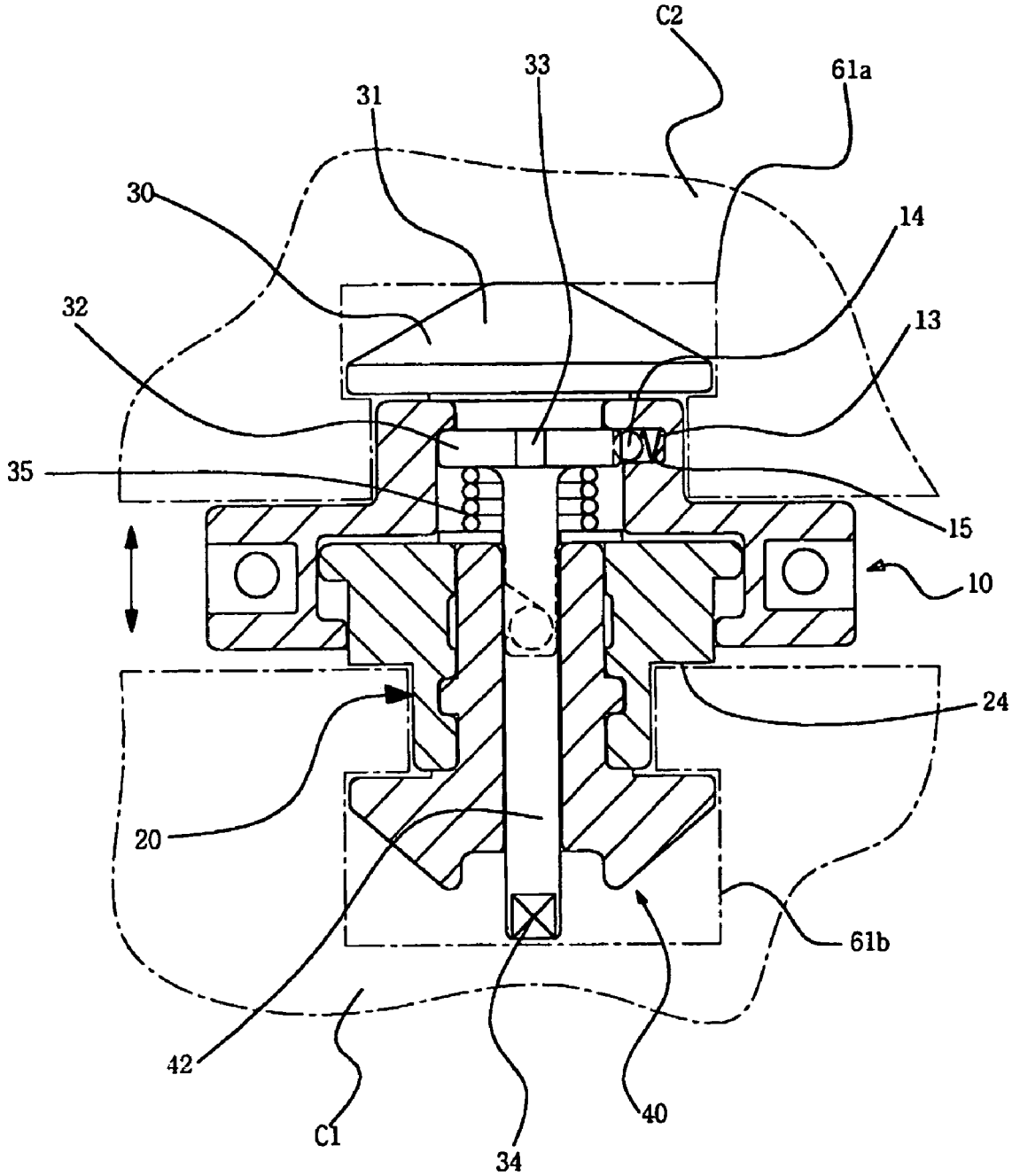
FIG. 5*c* is a sectional view illustrating a state wherein a lower locking head of the apparatus for automatically locking ship containers according to the present invention is locked to a corner casting of a container.
Figure 6:
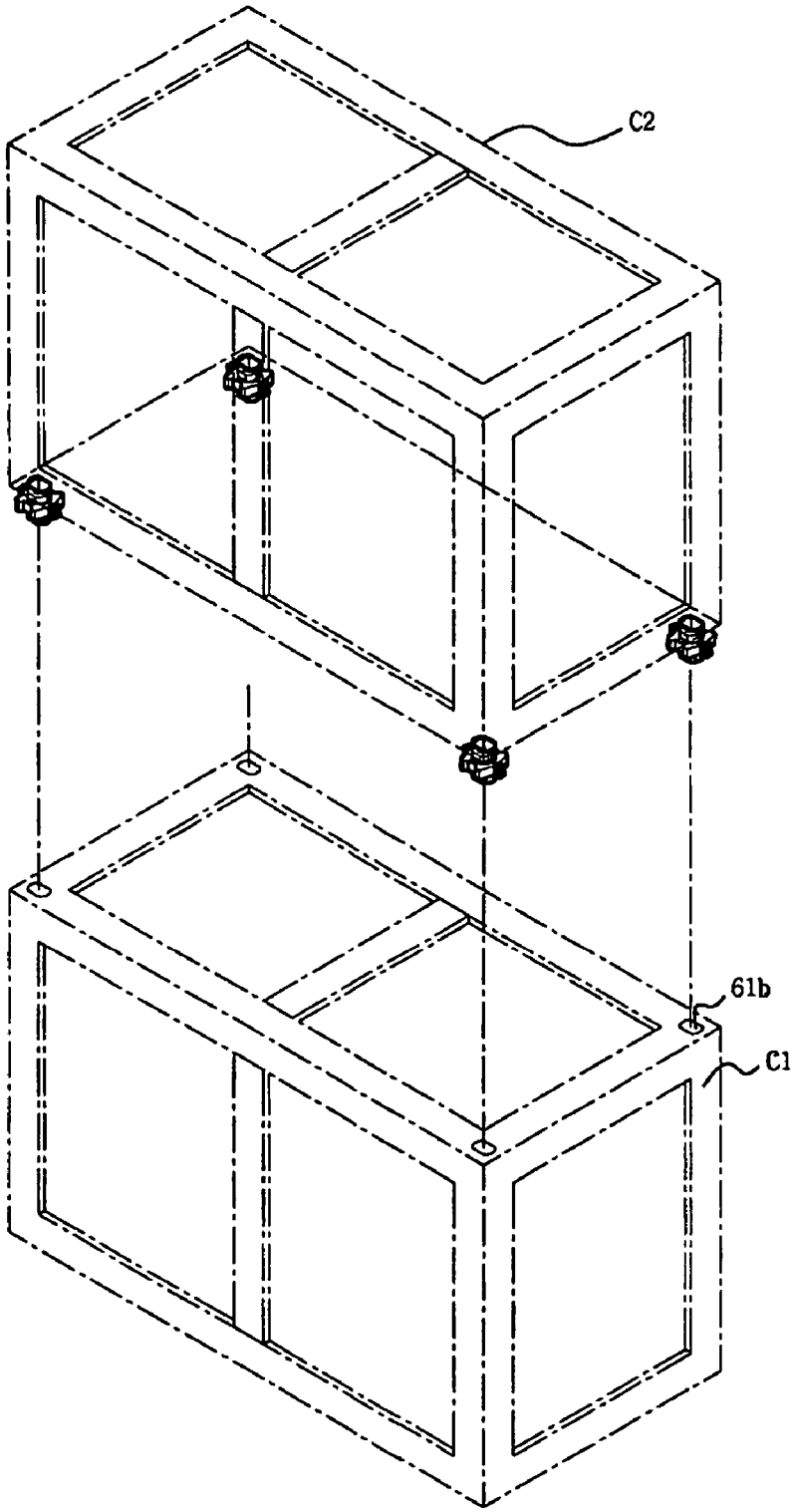
FIG. 6 is a schematic view illustrating an in-use state of the apparatus for automatically locking ship containers according to the present invention.

FIG. 5*a* is a sectional view illustrating an initial position of the apparatus for automatically locking ship containers according to the present invention; FIG. 5*b* is a sectional view illustrating a state wherein an upper locking head of the apparatus for automatically locking ship containers according to the present invention is locked to a corner casting of a container; FIG. 5*c* is a sectional view illustrating a state wherein a lower locking head of the apparatus for automatically locking ship containers according to the present invention is locked to a corner casting of a container; and FIG. 6 is a schematic view illustrating an in-use state of the apparatus for automatically locking ship containers according to the present invention. As can be readily seen from the drawings, in a state wherein a first container C1 is loaded on the bottom of a ship, a second container C2 is loaded on the first container C1. First referring to FIGS. 5*a* and 5*b*, after the apparatus for automatically locking ship containers according to the present invention is fitted into a first corner casting 61*a* which is provided to a lower surface of the second container C2, the portable lever 50 is placed around the lower free end 34 of the stem portion of the upper locker 30, which projects beyond the lower end of the center hole 42 of the lower locker 40. Then, by rotating the portable lever 50, the rotating body 32 of the upper locker 30 is rotated. As the rotating body 32 is rotated, the ball 14 which is inserted into the insertion groove 15 and biased outward by the spring 13 is received in one of the receiving grooves 33 of the rotating body 32, by which further rotation of the rotating body 32 is prevented.

When the rotating body 32 is rotated, the upper locking head 31 which is formed integrally with the upper locker 30 is also rotated. By this, as the upper locking head 31 is partially placed on the first corner casting 61*a* of the second container C2, a locking function is achieved (see FIG. 5*a*).

With the upper locking head 31 locked to the first corner casting 61*a* of the second container C2 as described above, the second container C2 is lifted by a crane or the like and then loaded on the first container C1 which is already loaded on the bottom of the ship.

At this time, the lower locking head 40 is fitted into a second corner casting 61*b* which is provided to an upper surface of the first container C1 already loaded, and then, the shoulder 24 of the operating element 20 is brought into contact with an upper surface of the second corner casting 61*b*. By a load applied by the second container C2, the operating element 20 is relatively moved upward while pressing the spring 35 which is placed around the stem portion of the upper locker 30.

As the lower locker 40 is relatively moved upward simultaneously with the movement of the operating element 20, the locking pin 12 which is fastened adjacent to the lower end of the housing 10 and held inserted into an upper end of the sloped groove 44 is moved downward along the sloped groove 44 which is defined at an angle of 45 with respect to the vertical line, to be finally positioned at a lower end of the sloped groove 44.

At this time, due to the fact that the locking pin 12 fastened to the housing 10 is partially inserted into the sloped groove 44 of the lower locker 40, the lower locker 40 is relatively moved upward while being rotated in a twisted manner.

Accordingly, as the lower locking head 43 which is formed integrally with the lower end of the lower locker 40 is simultaneously rotated, the lower locking head 43 is locked to the second corner casting 61*b* which is provided to the upper surface of the first container C1 (see FIGS. 5*b* and 5*c*).

As a consequence, by the presence of the locking apparatus according to the present invention, the first and second containers C1 and C2 can be firmly locked to each other.

When it is necessary to unlock the second container from the first container, the second container C2 is lifted using the crane or the like. By this, as the load applied to the operating element 20 is removed, the operating element 20 which is held relatively moved upward is relatively moved downward by the elastic force of the spring 35. At the same time with this, the lower locker 40 is again rotated in a twisted manner in an opposite direction due to the insertion of the locking pin 12 into the sloped groove 44.

Therefore, the locking pin 12 which is held at the lower end of the sloped groove 44 is moved upward to be positioned again at the upper end of the sloped groove 44.

As a result, as the lower locking head 43 which is locked to the second corner casting 61*b* which is provided to the upper surface of the first container C1 is rotated, the lower locking head 43 is removed from the second corner casting 61*b*, whereby the first and second containers C1 and C2 are unlocked from each other.

INDUSTRIAL APPLICABILITY

As apparent from the above description, the apparatus for automatically locking ship containers according to the present invention provides advantages in that, since a locker is operated by the weight of a container to automatically lock and unlock containers loaded on a ship to and from each other, the workability is improved when stacking containers one upon another and unloading the stacked containers one by one, and accidental displacement and release of the containers are prevented due to an increase in the container maintaining force, whereby safety is increased.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An apparatus for automatically locking shipping containers, comprising:

a housing having a seating surface on which a projection of an operating element is seated, a locking pin which is partially introduced into a sloped groove of a lower locker, and an insertion groove in which a spring and a ball are inserted;

the operating element being defined with a center opening and placed in the housing so that it can be moved upward and downward, the operating element having a tapered cut portion which is formed to allow the locking pin of the housing to extend into the center opening, an engagement groove in which a protrusion formed on an outer surface of the lower locker is engaged, and a shoulder which is to be brought into contact with a corner casting of a lower container;

an upper locker having an upper locking head which performs a locking function in a corner casting of an upper container, a rotating body which is defined with a receiving groove in which the ball inserted in the insertion groove of the housing can be received, and a stem portion which is integrally connected to the rotating body and around which a spring is placed, the upper locker passing through a center hole of the lower locker which is accommodated in the center opening of the operating element, to project beyond a lower end of the center hole; and the lower locker having the center hole through which the upper locker passes, the protrusion which is engaged in the engagement groove of the operating element, a lower locking head which performs a locking function in the corner casting of the lower container, and the sloped groove in which the locking pin formed adjacent to a lower end of the housing is partially introduced to be guided therealong.

* * * * *